US005346184A

United States Patent [19]

Ghosh

[11] Patent Number: 5,346,184

[45] Date of Patent: Sep. 13, 1994

[54] METHOD AND APPARATUS FOR RAPIDLY SOLIDIFIED INGOT PRODUCTION

[75] Inventor: Amit K. Ghosh, Ann Arbor, Mich.

[73] Assignee: The Regents of the University of Michigan, Ann Arbor, Mich.

[21] Appl. No.: 62,896

[22] Filed: May 18, 1993

[51] Int. Cl.[5] ..... B23K 15/00; B22D 23/00

[52] U.S. Cl. ..... 266/202; 266/236; 164/46; 164/485

[58] Field of Search ..... 266/202, 236; 164/46, 164/485, 474, 475, 479

[56] References Cited

U.S. PATENT DOCUMENTS 4,688,621 8/1987 Darmara ..... 164/46

5,176,874 1/1993 Mourer et al. ..... 266/202

*Primary Examiner*—Scott Kastler

*Attorney, Agent, or Firm*—Harness, Dickey & Pierce

[57] ABSTRACT

An apparatus and method for producing a rapidly solidified ingot characterized by a fine scale microstructure capable of precipitating uniformly dispersed fine particles. A charge of the material is placed in a crucible and heated by a furnace to melt the charge. The melt is discharged from the crucible in a stream along a pouring axis. An ingot mold is oriented at an angle with respect to the pouring axis so that the stream is received in the mold. As the melt is being poured into the mold, the mold is rotated about its central axis at a predetermined speed to continuously shear, both circumferentially and downwardly, a thin layer of the melt from the stream as the stream contacts the sidewall surfaces of the mold. The thin layer is rapidly solidified by the extraction of heat through the mold and is formed, as said ingot mold fills and successive layers are solidified, into an ingot having a fine microstructure capable of developing uniformly dispersed fine particles.

29 Claims, 3 Drawing Sheets

METHOD AND APPARATUS FOR RAPIDLY SOLIDIFIED INGOT PRODUCTION

BACKGROUND AND SUMMARY OF THE INVENTION

This invention generally relates to the field of metallurgy. More particularly, this invention relates to the production of rapidly solidified ingots.

It is well known that the properties of a metal or alloy can be affected by the cooling rate used to solidify the metal or alloy. Currently, there is a great interest in the development of alloys having uniformly dispersed, fine particles and a uniformly fine grained microstructure. It is known that rapid solidification can produce a uniformly dispersed and fine grained microstructure with a minimum amount of chemical segregation. Rapid solidification allows for massive phases to be eliminated from the alloy and for the solubility of the alloying elements to be increased. Such materials characteristically have high tensile, fatigue and creep strength. The fine grain size may also enable the materials to undergo enormous tensile elongations at elevated temperatures without experiencing fracture. This property, known as superplasticity, is obtained after extensive thermomechanical processing of the material containing uniformly dispersed particles, which produces a fine grain recrystallized microstructure.

In most cases, the uniform dispersion of fine intermetallic particles (200–500 nm in size) is not present in the alloy immediately after rapid solidification. The typical microstructure immediately after the rapidly solidification of the alloy is a fine, dendritic cast grain structure. The object of rapid solidification is to hold the constituents in solution, enabling them to precipitate out in a uniform manner during a subsequent heat treatment step. For certain alloys, the precipitation process may be partially completed during the rapid solidification step. A uniformly dispersed, fine precipitate structure is a prerequisite for developing a fine grain recrystallized (or recovered) microstructure during a subsequent thermomechanical processing operation. In the discussion which follows, for simplicity, the terms fine grain microstructure, finely dispersed microstructure, etc. are used interchangeably since both are simultaneously present in the thermomechanically processed material.

Rapid solidification and the production of uniformly distributed fine particles or dispersoids, however, is not trivial. Typically, the alloying elements are in solution when the alloy is in a molten state. During conventional casting, solidification rates of only 0.1°–1° K./s may be achieved. These solidification rates are insufficient to maintain the alloying elements in solution, which is necessary for producing a fine dispersion in the molten alloy and, as a result, insoluble intermetallic compounds precipitate out as coarse particles in the solidified ingot. The key to maintaining a fine dispersion of particles and an improved chemical homogeneity is rapid solidification, preferably in the range of 10°–1,000° K./s, of the molten alloy.

Several techniques have been developed to rapidly cool molten alloys and to thereby achieve the improved properties mentioned above. One prior art process produces rapidly cooled powders and then utilizes powder metallurgy processes, such as hot pressing or hot isostatic pressing, to consolidate the powders into a billet. According to methods of this type, the powders are made using a gas jet or a rotating spinner to atomize a stream of molten metal. The metal particles are rapidly solidified by a gas quenching medium to produce a chill cast powder. The cooled powder must then be consolidated to form a mill product suitable for fabrication into parts. This consolidation process might require some or all of the following: sizing of the powder, cold pressing of the powder, vacuum degassing, canning, hot compacting and other steps designed to form a dense product without introducing oxides, gases and other contaminants into the product.

Another known method of rapid solidification is melt spinning or melt extraction to produce rapidly solidified ribbons which then are consolidated into a workable product. Still another method involves spray forming and then depositing the spray droplets so as to form a solid ingot.

In one of the spray forming methods of rapid solidification, a molten alloy is allowed to flow onto a hot, spinning disc. The hot spinning disc atomizes the liquid and propels the tiny molten droplets outward to "splatter" against a water cooled mold where they rapidly solidify. The mold may move up and down relative to the spinning disc so that the droplets are spread along its inner surface. Movement of the mold is timed so that each layer is solidified before the next layer is deposited. Layers are repeatedly deposited until an ingot of a suitable thickness has been formed. This method is more cost effective then the two former methods because a solid product is obtained in a single step without having to consolidate the powder or pulverize ribbon materials.

The cost of spray formed materials is still greater than that of conventional or continuous casting processes. The reasons for the increased cost include the expense of the gas used in the atomization process, the high handling cost of the gas, the additional maintenance cost of the atomization nozzle and related structures, cost increases related to the subdivision of liquid into a spray which slows down the production process and makes the process more cumbersome. Furthermore, gas entrapment in the solid product can be a problem.

With the limitations of the prior art in mind, it is an object of the present invention to provide a method and apparatus for producing rapidly solidified ingots having uniformly distributed dispersoids and a fine scale microstructure.

This invention also seeks to provide an apparatus and process in which a rapidly solidified ingot is continuously cast in a one step process from a molten metal. As such, the present invention is a continuous process in that it forms an ingot without first dividing the melt in small, individual particles for solidification purposes and then recombining the solidified particles into an ingot form. This makes the invention a very cost effective method for producing rapidly solidified ingots.

In achieving the above objects, the present invention provides for a molten alloy to be held in a heated crucible having an opening through which the molten alloy flows into a chilled mold during production of the ingot. The mold itself is tilted at an angle relative to the pouring stream of the melt and is also rotated about this inclined axis.

As the molten alloy is being poured into the mold, it contacts the chilled mold surfaces and is sheared from the molten stream. The thin, sheared layer of the stream flows along the mold surface generally downward under the influence of gravity and sideways under the influence of the mold's rotation, in other words helically, toward the bottom of the mold. Depending on the rate at which the molten alloy is poured into the mold, the rotational speed of the mold is adjusted so that the sheared layer being deposited on the mold surfaces results in a thickness of about 0.2 mm. Also, the mold height and the pouring rate of liquid alloy must be controlled so that the alloy superheat is not lost significantly before the liquid contacts the mold surface, in other words, so that the liquid alloy does not partially solidify during the actual act of pouring.

The chilled mold and the thinness of the deposited alloy layer leads to a conduction dominated freezing of the sheared alloy and therefore a very high cooling rate. Depending on the pouring rate of the molten stream and the rotational speed of the mold, the inclination of the mold can be varied to ensure that the sheared alloy reaches the bottom of the mold before completely solidifying. To maintain the high cooling rate, as the bottom of the mold begins to fill-up with the solidified ingot, the inclination angle can also be varied during the course of melt deposition. Another possible approach to filling the mold would involve a slow horizontal displacement of the inclined mold to regulate the location where the molten stream hits the inside surface of the mold, or previously solidified alloy, thereby enabling the mold to be filled from the bottom to the top, as well radially inward and a combination thereof. Yet another approach may involve lowering the mold along the inclined axis, to allow the stream to contact a location higher up on the inside mold surface. This method would effectively achieve the same results as generally horizontally moving the mold. In another application, such as during use of large diameter molds, repeated to-and-fro horizontal motion may be required to allow the mold to completely fill from the bottom to top. After an ingot has been formed, it is removed from the mold so that it may be further worked, if needed, to achieve the desired fine grain recrystallized, or recovered, microstructure.

Since the rotation of the mold causes the molten alloy to be deposited in a thin, sheared layer, heat can be extracted at an extremely rapid rate causing the molten alloy to freeze without permitting insoluble intermetallic compounds to form and precipitate out as coarse particles in the solidified ingot. With the anticipated cooling rate of the melt being in the range of 1000° K./s, the alloying elements are held in solution and lead to a uniform dispersion of fine particles either directly after solidification or after a subsequent aging treatment. The resulting ingot will have a uniformly fine grained microstructure, in the as-cast condition and/or after suitable thermomechanical processing.

As can be seen from the brief discussion presented above, various designs for the mold and the mechanism for tilting, rotating and displacing the mold, relative to the poured stream of the molten alloy, are envisioned and within the purview of this invention. Furthermore, additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE PREFERRED EMBODIMENTS

Figure 1:
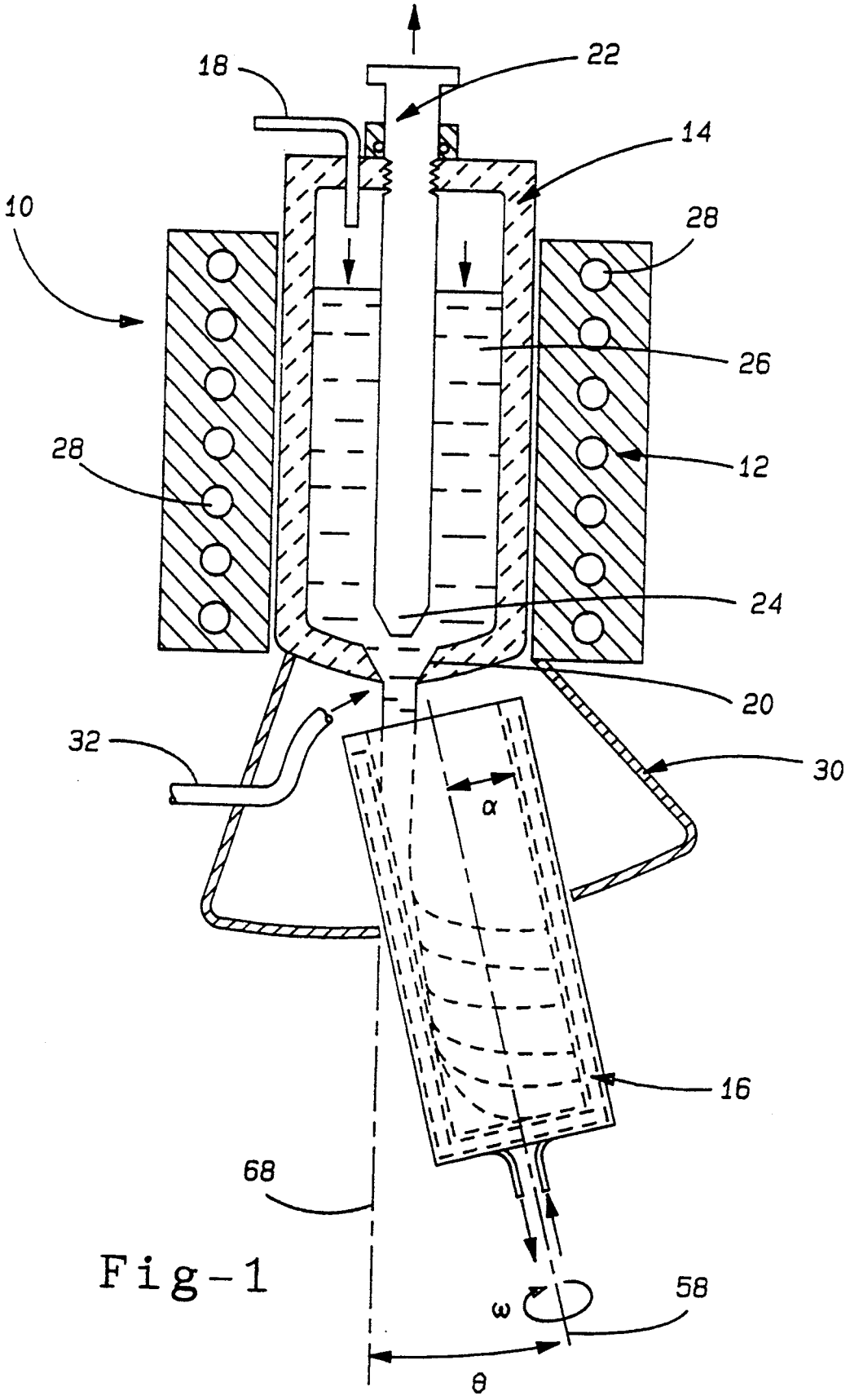
FIG. 1 is a diagrammatic view of an ingot being formed by the method and apparatus of the present invention.

Referring now to the drawing, an apparatus embodying the principles of the present invention is schematically illustrated in FIG. 1 and generally designated at 10. The apparatus generally includes a furnace 12, a crucible 14 and a mold 16.

In the discussion which follows, the term alloy is used in connection with the method and apparatus of the present invention. It should be understood, however, that the invention is not intended to be restricted to alloys. It is believed that the present invention will have utility to not only alloys, but also to the broad range of metals and metalloids, as well as various combinations of these, and even to non-metallic materials, which are typically employed in the casting processes.

A charge of materials for forming the alloy is first melted in the crucible 14. The crucible 14 must be non-reactive with the alloy constituents. Depending upon the particular alloy, various materials can be used for the crucible. For example, when forming aluminum alloy ingots according to the present invention, quartz, $ZrO_2$-coated graphite or BN-coated graphite can be used as crucible materials. For reactive materials, like titanium or titanium-aluminide, alternative methods must be used. Water cooled copper is often used as a crucible material so that a thin solidified skin of the alloy is maintained on the crucible surface thereby preventing possible contamination of the alloy by the crucible itself. To further prevent contamination, the crucible 14 may also be provided with an inert gas inlet 18. As will be better understood from the discussion which follows, numerous crucible designs could be appropriately used herein without departing from the teachings of the present invention.

The lower end of the crucible 14 is provided with an opening 20 so that the molten alloy (hereinafter melt 26) can flow out of the crucible 14 and into the mold 16 as further described below. A screw operated or other type of plug 22, including a tip 24 configured to engage the opening 20 and serve as a valve controlling the flow of the melt 26 therethrough, is also provided with the crucible 14.

The constituents of the alloy can be placed within the crucible 14 in solid form. Often, master alloys containing a rich alloy of a given constituent are used in small quantities to arrive at the correct chemical composition in the final alloy. By applying power to the furnace 12, the constituents are heated and melted into a liquid state. The furnace 12 surrounds the crucible 14 and, like the crucible 14, may be of one of the varieties well known in the industry. As such, the furnace 12 may be resistance heated, induction heated or of an alternate kind. In the illustrated embodiment, the furnace 12 is an induction furnace and is provided with induction coils 28. The furnace 12 can also be constructed so that a thermal gradient is formed within the crucible 14 to generate a convection current for mixing and homogenizing the melt 26. For certain alloys, magnetic or mechanical stirring may be introduced. If reactive metals are being melted in a water cooled, copper crucible 14, a plasma arc furnace may be used. In this case, rather than bottom pouring, side pouring from the crucible 14 is used.

The alloy is melted to a significant superheat (100°–400° C.) above the liquidus temperature or melting point of the particular alloy constituents. The superheat assures that high melting constituents are in complete solution (such constituents may be intermetallic compounds of high melting point elements, such as intermetallics of manganese, zirconium, chromium, etc. in aluminum alloys, which will go in solution in the liquid state). The superheat also allows the high rate of cooling to be established before or during the actual solidification of the alloy.

When the appropriate temperature and mixing of the melt 26 have been achieved, the plug 22 is manipulated to allow the melt 26 to flow through the opening 20. An inert gas, introduced through the gas inlet 18 from the top of the crucible 14, can be used to apply positive pressure downward on the melt 26 causing the pouring stream of the melt 26 to flow onto the surface of the mold 16 at a steady rate. A shroud 30 is positioned below the crucible 14 and generally around the upper opening of the mold 16. Prior to the pouring of the melt 26 into the mold 16, an inert gas, such as argon, is provided through the gas inlet 32 to purge air from the interior of the mold 16. For highly reactive metals such as titanium, an inert gas chamber may be required.

The mold is constructed so that a high rate of heat extraction and a high rate of solidification may be achieved. The mold temperature is maintained well below the solidification temperature of the alloy to achieve this goal. The mold 16 used in the present invention may have a variety of possible designs. These variations in and of themselves, however, do not alter the principles or the scope of the present invention.

Figure 2:
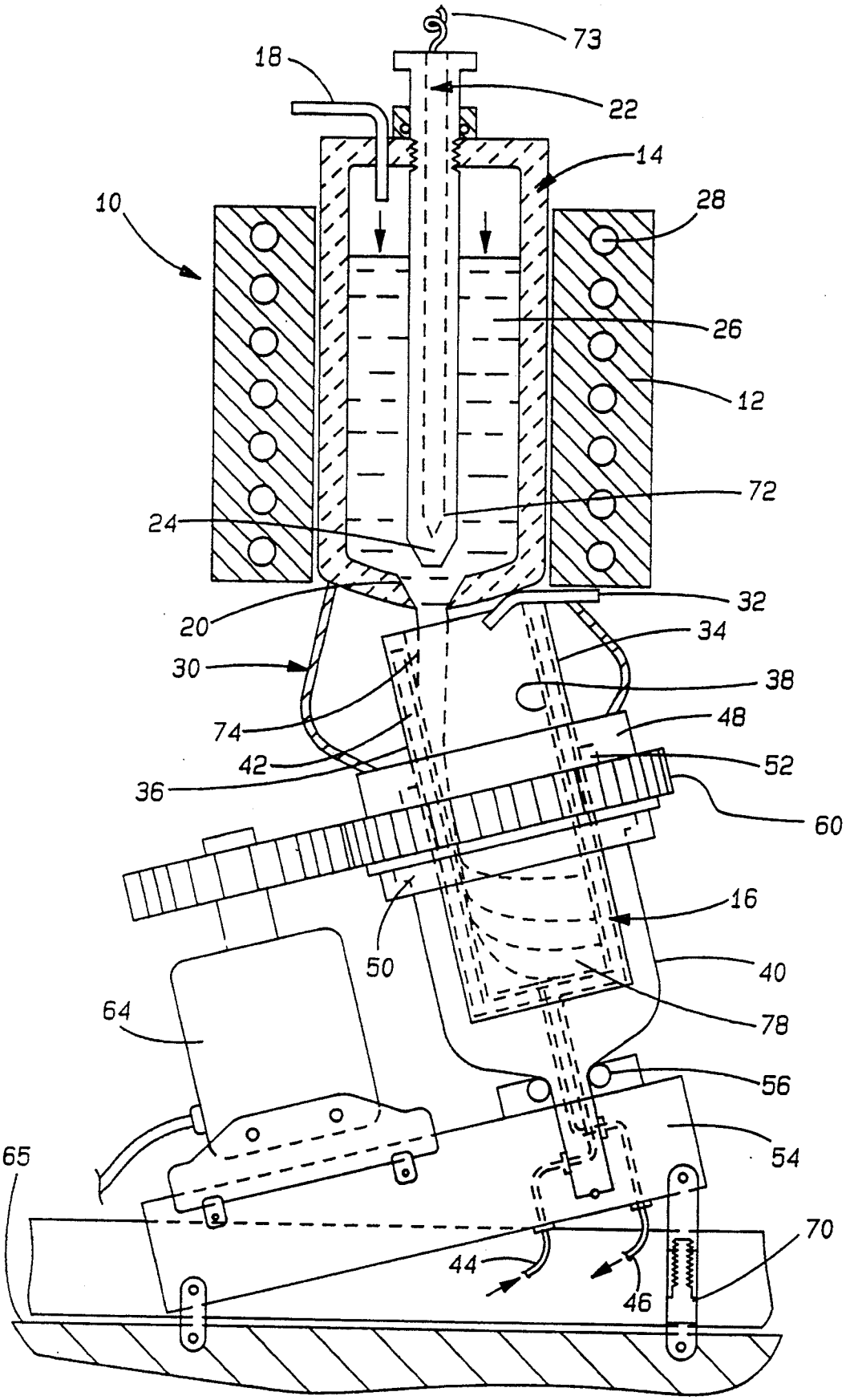
FIG. 2 is a more detailed schematic illustration of one embodiment of the present invention.

Referring now to FIG. 2, one particular embodiment of the present invention is illustrated therein. In the illustrated embodiment, the mold 16 has a longitudinally split construction and includes mated first and second halves 34 and 36. The mold 16 is made from a highly (thermally) conductive material, such as copper, and the first and second half sections 34 and 36 cooperate to define a mold surface 38 which further defines an inner cavity of the mold 16. The mold cavity can have any one of a number of cross-sectional shapes including circular, rectangular or square.

In the illustrated design of the mold 16, the first and second halves 34 and 36 of the mold 16 are mated together and positioned within a mold base 40 which prevents their separation. While alternate cooling mechanisms could be used with equal success, in the present invention cooling passages 42 are formed in both the mold base 40 and the mold 16 itself. The passages 42 are aligned and enable cooling water (or fluid) to be cycled in and out of the mold 16 from a source (not shown) through an inlet tube 44 and an outlet tube 46. To firmly lock the mold halves 34 and 36 to one another and the mold 16 to the mold base 40, a yoke 48, preferably made of steel or aluminum, is clamped or otherwise secured around the mold 16 and the mold base 40. To prevent withdrawal out of the yoke 48, the mold base 40 and the mold halves 34 and 36 are each respectively provided with radial flanges or tabs 50 and 52 that coact with recesses formed in the yoke 48. To prevent relative rotation between the yoke 48, the mold 16 and mold base 40, various means can be used. One such means would be to provide the mold 16 and mold base 40 with a non-circular exterior shape.

The mold base 40 is carried on a platform 54 by a rotatable mounting generally illustrated as including bearings 56. The mold base 40 is provided in this fashion so that it is capable of rotating about a central axis 58 generally corresponding with the center of the mold 16. To cause rotation in the mold 16, a toothed gear wheel 60 is rigidly secured by fasteners or other means on the exterior of the yoke 48. The gear wheel 60 engages a drive gear 62 mounted on a drive shaft 64 connected to a high output motor 66. While various types of motors 66 could be used with the present invention, the motor 66 will preferably be capable of inducing rotational speeds ($\omega$) of 20–2000 rpm in the mold 16. Obviously, greater or lesser rotational speeds than those specified above could be utilized. The exact speed of rotation will depend on specific designs criteria such as the inner diameter of the mold, the rate of flow of the melt, as well as the materials making up the constituents of the melt and its fluidity. In place of the gear and motor construction illustrated in FIG. 2, alternate constructions could readily be used to impart rotation to the mold 16. Such constructions are obviously deemed to be in the purview of the present invention.

The platform 54 is mounted to a foundation surface 65 and is also provided so that it will orient the mold 16 and axis 58 at an inclined orientation with respect to a vertical or pouring axis 68 that will be generally defined by the molten stream of the melt 26 being poured from the crucible 14. While the platform 54 could be provided with a fixed inclination, in the preferred embodiment the inclination angle, defined as the angle between the pouring axis 68 and the central axis 58 and designated as theta ($\theta$), can be varied by raising or lowering one end of the platform 54. Various means can be utilized to raise or lower the end of the platform 54 and vary the inclination angle, such as a mechanically, hydraulically or pneumatically adjustable leg 70.

As mentioned above, prior to the pouring of the melt 26 from the crucible 14 into the mold 16, inert gas, such as argon, is provided through the gas inlet 32 to purge air from the interior cavity of the mold 16. Once the mold cavity and the area defined by the shroud 30 have been purged of air, the motor 64 is energized causing the mold 16 to rotate. The flow of inert gas is maintained throughout the duration of the entire pouring process to provide an inert blanket or shield and prevent contamination from the surrounding air. For highly reactive alloys, the shroud 32 is not used and the whole apparatus is located inside a chamber. A thermocouple 72, located in the plug 22 and connected by a lead 73 to a monitor/control system (not shown), is used to measure and determine whether the melt 26 is at the desired superheat temperature for pouring.

When the melt 26 is fully heated and mixed, the plug 22 is actuated so as to be withdrawn from the opening 20 and to allow a steady stream 74 of the melt 26 to pour along the pouring axis 68 onto an upper sidewall of the mold surface 38. The inclination of the mold 16 as well as its rotation about the axis 58, causes a thin layer of the melt 26 to be sheared from the poured stream 74. Because of the mold's inclination and rotation, shearing is generally effectuated both downwardly and circumferentially causing the melt to spread generally in a helix over the mold surface 38 down toward the bottom of the mold 16 where it is rapidly solidified. The sheared layer of the stream 74 is generally illustrated in FIG. 1 at 76.

Preferably, the sheared layer has a thickness of about 0.2 mm which allows for a very high degree of undercooling. Depending upon the pouring rate of the melt 26, the rotational speed of the mold 16 is adjusted to achieve and maintain this sheared layer thickness. It is believed that rotational speeds of between 20 and 2000 rpm will be adequate with an undercooling of about 400° C. to achieve a 1000° K./s cooling rate during solidification of the melt 26.

As the bottom of the mold begins to fill-up and form a rapidly solidified ingot, generally designated at 78, the inclination angle may be adjusted to ensure that the desired solidification rate is maintained for the sheared layer 76. The flow rate of the stream 74 out of the crucible 14 and into the mold 16 can also be adjusted to help control the solidification rate. While an inclination angle between 5° and 15°, with respect to vertical, is believed to be sufficient to allow the flowing stream 74 to be sheared at the proper thickness and reach the bottom of the mold 16, values for the inclination angle of between 2° and 40° (or greater) may be required for particular applications and different viscosities of the liquid alloy. Alternative methods, as further discussed below, could also be employed to maintain the desired solidification rate.

In a variation of the process of the present invention, the gas inlet 32 can be directed specifically toward the stream 74 of the melt 26. The inlet design can be modified to allow ceramic reinforcement particles or whiskers (e.g., SiC, $Al_2O_3$, $TiB_2$, etc.) to be propelled with the argon gas to shower down into the mold 16 and be included within the molten stream 74 of the melt 26. A composite ingot so produced would exhibit minimized interfacial degradation at the metal-ceramic interface since the contact time between the melt 26 and the reinforcement particles would be minimized by the rapid solidification rate. This composite fabrication method might also be performed by injecting particles of other metals (e.g., Ti, Ni, Nb etc.) and intermetallics (e.g., NiAl, TiAl, $Nb_3Al$ etc.) into the matrix alloy.

Figure 3:
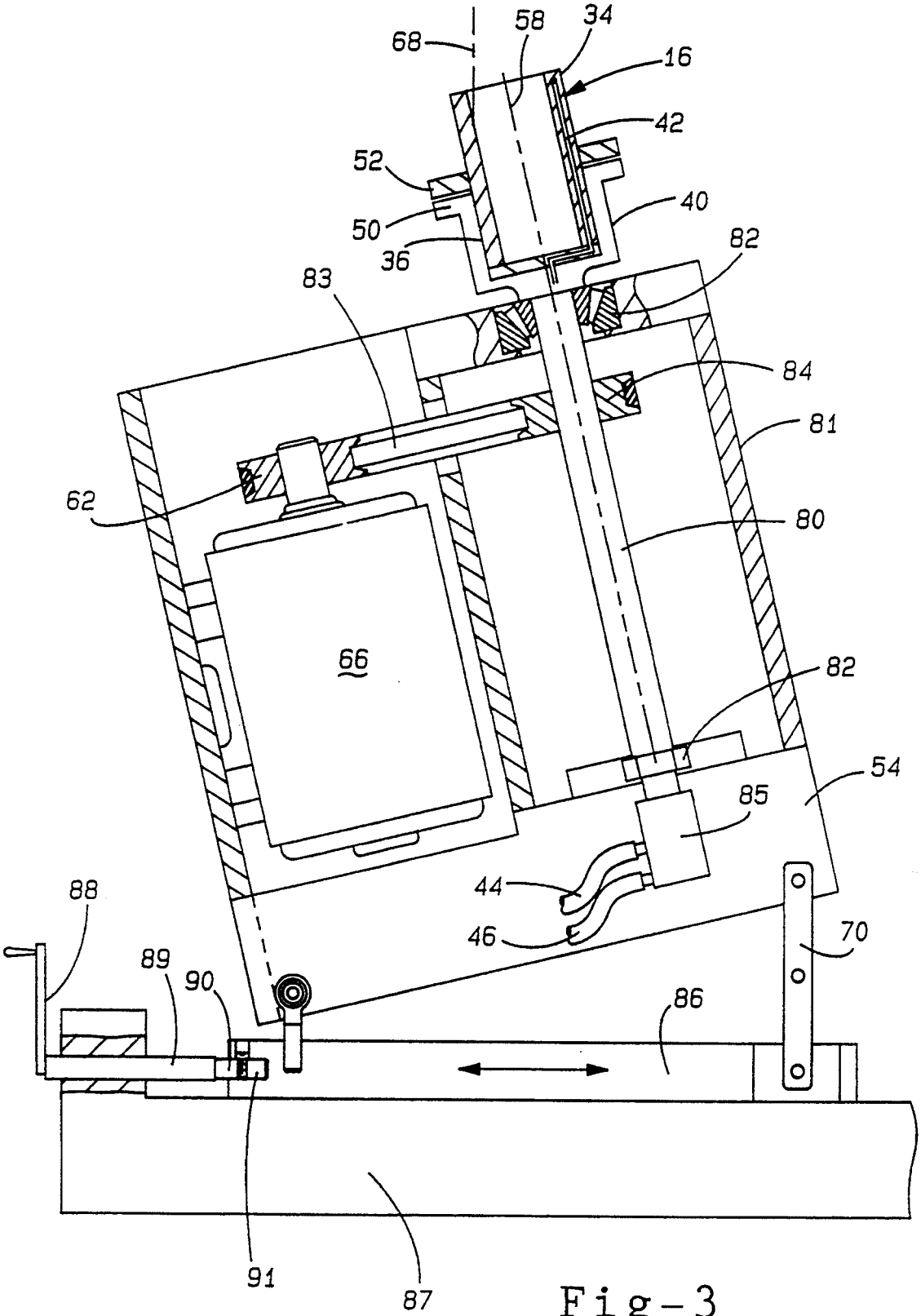
FIG. 3 is a detailed schematic illustration of another embodiment of the present invention.

A further embodiment of the apparatus of the present invention is shown in FIG. 3, without the crucible 14 and furnace 12. In this design, the mold 16 is held in a mold base 40 having a long rigid shaft 80 which is guided and rotatably supported by bearings 82 within a housing 81. Also enclosed by the housing 81 is a motor 66 which includes a drive gear 62 coupled by a belt 83 to another gear 84 rigidly mounted on the shaft 80. The mold halves are firmly held in the mold base 40, by a yoke (not shown), for rotation with the shaft 80 and mold base 40. The shaft 80 also contains inlet and outlet cooling water passages (not shown) which lead from the inlet and outlet tubes 44 and 46, through a rotary union 85, to the cooling passages 42 in the mold halves 34 and 36.

The housing 81 is secured to a tiltable platform 54. In addition to supporting the tilting mechanism 70, which controls the inclination or position of the central axis 58 with respect to the vertical or pouring axis 68, the platform 54 is supported on a base 86 which can be moved horizontally to adjust the location where the melt stream 74 impacts the interior mold surface 38. This capability of horizontal movement of the base 86, and therefore the mold 16, allows the embodiment to avoid the need for adjusting the inclination of the mold 16 during the pouring stage to ensure continual rapid solidification during filling of the entire mold 16. The base 86 is slidably supported on a fixed base 87, with the capability to be firmly locked into any position, and is made horizontally movable by one of many mechanical means. Shown in FIG. 3 is a simple manual design in which the base 86 can be moved by rotating a crank 88 connected to a shaft 89 which has a threaded end 90 engaged with a threaded bore 91 in the movable base 86. Obviously, the manual setup for horizontally moving the base 86 could be replaced by an automated system which could more accurately control the movement.

Additional features common to the previously discussed embodiment, are illustrated in FIG. 3 and designated with like references.

In addition to moving the base 86 and mold 16 horizontally, the present invention could be provided so as to move the mold 16 vertically or downward along the central axis 58 while the pouring stream 74 is impacting the mold 16. Additionally, the mold 16 could be moved so s to undergo a combination of vertical and horizontal movements which do not specifically result in movement of the mold corresponding to the central axis.

By utilizing the apparatus and method of the present invention, significant benefits in terms of rapid solidification of an ingot can be achieved over the prior art methods. The rotational and tiltable mold 16 can be easily and economically incorporated into conventional casting designs. The mold 16 (FIG. 2) is easily accessed since an air tight inert ga chamber is not specifically needed, except in the case of an extremely reactive metal (e.g. Ti, Nb, $Ti_3Al$ etc). Contamination of the material forming the ingot 78 is minimized since there is no significant droplet creation or deposition involved during solidification. Contamination is also kept a minimum since the melt 26 continuously meets either the chilled mold 16 or a layer of previously deposited material. Ingot porosity is excepted to be less because of the continuous shearing of the molten stream 74 and its subsequent "smearing" across the casting surfaces 38 rather than the consolidation of solidified droplets or powder particles required by the prior art processes. Because any impurities can be distributed in an extremely fine scale by this method, expensive high purity starting stock is not necessary to develop alloys with high fracture toughness and extensive formability.

In summary, the present invention provides for an apparatus for producing a rapidly solidified ingot in which the ingot exhibits a uniformly fine grained microstructure containing uniformly dispersed second phase particles. The apparatus comprising: a crucible capable of receiving a charge of the material for forming the ingot, the crucible having portions defining a discharge opening; a furnace capable of heating the crucible and melting the materials into a melt, the melt being dischargeable through the discharge opening in a stream along a pouring axis; an ingot mold including a bottom wall and sidewalls and having interior surfaces cooperating to generally define a mold cavity, the mold cavity having a central axis extending longitudinally therethrough, the ingot mold also having portions defining an opening opposite the bottom wall and configured to receive the melt being poured and provide unobstructed access for the melt into the mold cavity; means for supporting the ingot mold and orienting the ingot mold such that the central axis is inclined with respect to the pouring axis at an inclination angle being defined therebetween; and means for rotating the ingot mold about the central axis at a predetermined rotational speed as the melt is being poured into the ingot mold to shear a thin layer of the melt from the poured stream as the stream contacts the interior surfaces, the layer being sheared and generally covering a portion of the interior surfaces of the sidewalls and the bottom wall where the layer is rapidly solidified by the extraction of heat through the mold walls, the position of the rotating mold being horizontally or vertically adjusted to allow the liquid stream to impact at varying locations on the mold (or predeposited alloy) allowing the mold to gradually fill up as successive layers are solidified, thereby forming an ingot containing a fine scale microstructure and being capable of precipitating fine particles.

The invention also provides for a method of producing a rapidly solidified ingot in which the ingot exhibits uniformly dispersed particles and a fine scale microstructure which may be formed during casting or produced by subsequent thermomechanical working of the ingot. The method comprising the steps of: providing a crucible; placing a charge of material for forming the ingot in the crucible; forming a melt from the charge; discharging the melt from the crucible in a stream along a pouring axis; providing an ingot mold having sidewalls with interior surfaces defining a receiving cavity, a longitudinal axis extending through the receiving cavity; positioning the ingot mold to receive the stream in the cavity; orienting the ingot mold such that the central axis is inclined with respect to the pouring axis at an inclination angle being defined therebetween; rotating the ingot mold about the central axis at a predetermined rotational speed as the stream is being poured into the ingot mold to shear a thin layer of the melt from the stream as the stream contacts the interior surfaces of the ingot mold; rapidly solidifying the sheared layer in the rotating ingot mold; adjustably positioning the rotating mold either horizontally, vertically or along the axis of rotation to allow the poured liquid stream to impact at varying locations on the mold surfaces as successive layers are applied and the mold fills up, there forming an ingot being capable of precipitating uniformly dispersed fine grained particles.

While the above description constitutes the preferred embodiments of the present invention, it will be appreciated that the invention is susceptible to modification, variation and change without departing from the proper scope and fair meaning of the accompanying claims.

What is claimed is:

1. An apparatus for producing a rapidly solidified ingot of a material having a fine scale microstructure capable of precipitating uniformly dispersed fine particles, said apparatus utilizing a furnace and a crucible capable of heating the material into a melt and pouring the melt from the crucible in a stream generally defining a pouring axis, said apparatus comprising:

an ingot mold including a bottom wall and sidewalls having interior surfaces generally cooperating to define a mold cavity having a central axis extending longitudinally therethrough, said ingot mold also including portions defining an opening opposite said bottom wall, said opening being configured to receive the melt being poured;

means for positioning said mold in an inclined position with respect to the pouring axis such that an inclination angle is defined between said central axis and the pouring axis; and means for rotating said ingot mold about said central axis as the melt is poured into said ingot mold to shear a thin layer of the melt from the poured stream as the stream contact said interior surfaces, said ingot mold being capable of extracting heat and rapidly solidifying the sheared layer into an ingot having a fine scale microstructure capable of precipitating uniformly dispersed fine particles as successive layers are applied thereto.

2. An apparatus as set forth in claim 1 wherein said positioning means is adjustable.

3. An apparatus as set forth in claim 1 wherein said positioning means is capable of varying said inclination angle as the ingot is being formed.

4. An apparatus as set forth in claim 1 wherein said inclination angle is between 2 and 40 degrees.

5. An apparatus as set forth in claim 1 wherein said means for rotating said ingot mold is capable of varying the rotational speed of said ingot mold as the ingot is being formed.

6. An apparatus as set forth in claim 1 further comprising means for moving said ingot mold horizontally relative to said pouring axis.

7. An apparatus as set forth in claim 1 further comprising means for moving said ingot mold vertically relative to said pouring axis.

8. An apparatus as set forth in claim 1 further comprising means for moving said ingot mold axially along said central axis.

9. An apparatus for producing a rapidly solidified ingot, the ingot being formed of a material having a fine scale microstructure capable of precipitating uniformly dispersed fine particles, said apparatus comprising:

a crucible having a cavity of receiving a charge of the materials for forming the ingot therein, said crucible including discharge means for discharging the materials therefrom;

heating means for heating said crucible and melting said charge to form a melt, said melt being dischargeable from said crucible through said discharge means in a stream generally defining a pouring axis;

an ingot mold including interior surfaces and a bottom generally cooperating to define a mold cavity having a central axis extending longitudinally therethrough, said ingot mold also having means for cooling said ingot mold and portions defining an opening generally configured to provide unobstructed access for receiving said melt into said mold cavity;

means for supporting said ingot mold and for orienting said ingot mold such that said central axis is inclined with respect to said pouring axis at an inclination angle, said inclination angle being defined between said pouring axis and said central axis; and means for rotating said ingot mold about said central axis as said melt is being poured into said ingot mold, rotation of said ingot mold causing a layer of said melt to be sheared from said stream as said stream contacts said interior surfaces, said layer being sheared generally circumferentially and downwardly so as to cover a portion of said interior surfaces and said bottom, said layer being rapidly solidified by the extraction of that through said ingot mold and thereby being formed into an ingot having uniformly dispersed fine particle as successive layers are applied thereto.

10. An apparatus as set forth in claim 9 wherein said pouring axis is generally vertical.

11. An apparatus as set forth in claim 9 wherein said means for orienting said ingot mold is capable of varying said inclination angle as said melt is being poured.

12. An apparatus as set forth in claim 9 wherein said means for rotating said ingot mold is capable of varying the rotational speed of said ingot mold as said melt is being poured.

13. An apparatus as set forth in claim 9 further comprising means for generally horizontally moving said ingot mold relative to said pouring axis.

14. An apparatus as set forth in claim 9 further comprising means for axially moving said ingot mold along said central axis.

15. An apparatus as set forth in claim 9 further comprising means for moving said ingot mold vertically relative to said pouring axis.

16. An apparatus as set forth in claim 9 further comprising means for introducing particles of another material into said stream and said layer before said layer is rapidly solidified to form said ingot.

17. An apparatus as set forth in claim 16 wherein said particles of another material are ceramic.

18. A method of producing a rapidly solidified ingot formed of a material having a fine scale microstructure capable of precipitating uniformly dispersed fine particles, said method comprising the steps of:

providing a crucible;

placing a charge of material for forming said ingot in said crucible;

heating said charge to form a melt;

discharging said melt from said crucible in a stream along a pouring axis;

providing an ingot mold having sidewalls with interior surfaces defining a receiving cavity and a central axis extending through said receiving cavity;

positioning said ingot mold to receive said stream in said cavity;

positioning said ingot mold to receive said stream in said cavity;

orientating said ingot mold such that said central axis is inclined with respect to said pouring axis at an inclination angle defined between said central and pouring axes;

rotating said ingot mold about said central axis as said stream is being poured into said ingot mold;

shearing a thin layer of said melt from said stream as said stream contacts said interior surfaces of said ingot mold; and rapidly solidifying said sheared layer in said rotating ingot mold to form an ingot having a fine grain microstructure capable of precipitating uniformly dispersed fine particles as successive layers are applied thereto.

19. A method as set out in claim 18 wherein said ingot mold is oriented at an inclination angle between 2 and 40 degrees.

20. A method as set out in claim 18 wherein said ingot mold is rotated at a rotational speed between 20 and 2000 revolutions per minute.

21. A method as set out in claim 18 further comprising the step of varying said inclination angle as said ingot is being formed to maintain rapid solidification of said sheared layer.

22. A method as set out in claim 18 wherein said stream is received onto an interior surface of said sidewalls.

23. A method as set out in claim 18 further comprising the step of purging air from said receiving cavity with an inert gas.

24. A method as set out in claim 18 further comprising the step of varying the rate at which said ingot mold is rotated.

25. A method as set out in claim 18 further comprising the step of moving said mold generally horizontally with respect to said pouring axis.

26. A method as set out in claim 18 further comprising the step of moving said mold vertically with respect to said pouring axis.

27. A method as set out in claim 19 further comprising the step of moving said mold axially along said central axis.

28. A method as set out in claim 18 further comprising the step of working said ingot to precipitate a fine grained microstructure.

29. A method as set out in claim 18 wherein said sheared layer has a thickness of at least 0.2 mm.

* * * * *

UNITED STATES PATENT AND TRADEMARK OFFICE

CERTIFICATE OF CORRECTION

PATENT NO. : 5,346,184

DATED : September 13, 1994

INVENTOR(S) : Amit K. Ghosh

It is certified that error appears in the above-indentified patent and that said Letters Patent is hereby corrected as shown below:

Column 10, line 31, Claim 9, after "cavity" insert —capable—.

Column 11, lines 38 and 39, Claim 18, Delete second "positioning said ingot mold to receive said stream in said cavity;"

Signed and Sealed this

Twenty-fourth Day of January, 1995

*Attest:*

Bruce Lehman

BRUCE LEHMAN

*Attesting Officer*

*Commissioner of Patents and Trademarks*